United States Patent [19]

Maroszek

[11] Patent Number: 5,052,552

[45] Date of Patent: Oct. 1, 1991

[54] FOLDABLE CARRIER FOR A PLURALITY OF CONTAINERS

[75] Inventor: Raymond V. Maroszek, Neenah, Wis.

[73] Assignee: James River-Norwalk, Inc., Norwalk, Conn.

[21] Appl. No.: 729,758

[22] Filed: May 2, 1985

[51] Int. Cl.[5] ..... B65D 75/00

[52] U.S. Cl. ..... 206/174; 206/171; 206/172; 206/175; 206/180; 206/199; 206/427

[58] Field of Search ..... 206/143, 146, 147, 157, 206/163, 164, 170, 171, 172, 174, 175, 180, 181, 199, 427, 162, 165, 168, 173, 185, 186, 195, 193; 229/28 BC, 52 BC, 27, 28 R, 40, 41 R, 41 B, 52 B

[56] References Cited

U.S. PATENT DOCUMENTS

| | | | |
|---|---|---|---|
| D. 198,481 | 6/1964 | Koolnis . | |
| 2,215,907 | 9/1940 | Klien et al. | 229/52 BC |
| 2,217,028 | 10/1940 | Powell | 229/52 BC |
| 2,268,209 | 12/1941 | Ford et al. | 229/52 BC |
| 2,371,312 | 3/1945 | Potter . | |
| 2,372,351 | 3/1945 | Arneson . | |
| 2,373,851 | 4/1945 | Potter | 229/52 BC |
| 2,402,219 | 6/1946 | Wesselman | 206/195 |
| 2,435,178 | 1/1948 | Marshall . | |
| 2,446,161 | 7/1948 | Price | 206/172 |
| 2,523,986 | 9/1950 | Foster | 229/52 BC |
| 2,594,376 | 4/1952 | Arneson | 206/172 |
| 2,653,742 | 9/1953 | Currie | 229/52 BC |
| 2,676,731 | 4/1954 | Klein | 206/427 |
| 2,719,650 | 10/1955 | Buttery et al. | 206/172 |
| 2,805,813 | 9/1956 | Rittmueller | 229/52 B |
| 2,828,047 | 3/1958 | Weiselberg . | |
| 2,830,726 | 4/1958 | Foster | 229/40 |
| 2,835,429 | 5/1958 | Pellaton | 229/41 R |
| 2,932,424 | 4/1960 | Arneson | 206/186 |
| 2,967,003 | 1/1961 | Forrer et al. . | |
| 3,204,815 | 9/1965 | Weiss | 206/171 |
| 3,352,451 | 11/1967 | Struble | 229/52 B |
| 3,352,452 | 11/1967 | Graser | 206/187 |
| 3,389,831 | 6/1968 | Hirota | 206/172 |
| 3,515,335 | 6/1970 | Atkinson | 206/165 |
| 3,565,323 | 2/1971 | Katzenmeyer . | |
| 3,589,593 | 6/1971 | Weiss | 229/40 |
| 3,598,302 | 8/1971 | Nowak | 229/40 |
| 3,640,380 | 2/1972 | Hoffman | 229/52 B |
| 3,780,906 | 12/1973 | Katzenmeyer . | |
| 3,891,084 | 6/1975 | Elizondo-Garcia | 206/199 |
| 3,963,121 | 6/1976 | Kipp | 206/165 |
| 3,994,397 | 11/1976 | Fishlove | 229/40 |
| 3,999,660 | 12/1976 | Tranquillitsky | 229/40 |
| 4,032,053 | 6/1977 | Wilson | 229/52 BC |
| 4,130,237 | 12/1978 | Struble | 229/40 |
| 4,278,197 | 7/1981 | Scheinbaum et al. | 229/52 BC |

*Primary Examiner*—David T. Fidei

*Attorney, Agent, or Firm*—Finnegan, Henderson, Farabow, Garrett & Dunner

[57] ABSTRACT

A carton structure erectable by folding from a substantially flat blank includes two side panels, a bottom panel, two top panels, a center divider panel and two end panels, each extending from the bottom panel. Each end panel has slot means for engaging the center divider panel when the carton is erected. The carton structure further includes four reinforcing areas, each having a first edge connected by a first fold line to an end panel and a second edge connected by a second fold line to one of the side panels.

19 Claims, 2 Drawing Sheets

FOLDABLE CARRIER FOR A PLURALITY OF CONTAINERS

BACKGROUND OF THE INVENTION

1. Field of the Invention

The present invention relates to carriers and, more particularly, to carriers including a carton structure erectable by folding from a substantially flat blank.

2. Description of the Related Art

Food and beverages are often purchased by a consumer and then carried a short distance to another place where they are consumed. The food and beverages are usually placed in a box or other carrier in order to facilitate the transport of the items. However, when cups of beverages are placed in a box, they may readily tip over and spill, particularly if the carrier structure lacks sufficient rigidity.

Most known carrier structures lack the rigidity necessary to prevent spillage. The remaining known carrier structures are sufficiently rigid, but lack simplicity in manufacture and ease in erecting the carrier for use.

It is an object of the present invention to provide a carrier for containers which is sufficiently rigid to prevent spillage.

It is another object of the present invention to provide a container carrier which is simple to manufacture and easy to erect.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, a carton structure erectable by folding from a substantially flat blank is provided comprising: two side panels, each having end edges; a bottom panel extending between the side panels; two top panels, each top panel extending inwardly from one of the side panels, the top panels spaced from the bottom panel; a center divider panel intermediate the two top panels and connected to each top panel; two end panels, each extending from the bottom panel, each end panel having slot means for engaging the center divider panel when the carton is erected.

It is preferable that the carton structure includes four reinforcing areas, each reinforcing area having a first edge connected by a fold line to a side edge of one of the end panels and a second edge connected by a fold line to one of the side panels. It is further preferable that the second edge of each reinforcing area is aligned with an intersection between one of the side panels and the bottom panel when the carton is unerected, whereby the carton structure is collapsible into a flattened unit.

It is further preferable that the blank is a single sheet folded and extending so that one end of the sheet is attached to the inside of the bottom panel, extending upward to form a lower portion of the center divider panel, extending further upward past the two top panels to form a first upper portion of the center divider panel, folded back upon itself to form the upper edge of the center divider panel, extending downward to form a second upper portion of the center divider panel, extending outward to form one of the top panels, extending downward to form one of the side panels, extending horizontally to form the bottom panel, extending upward to form the second side panel, extending inward to form the second top panel, extending from the second top panel and attached to the center divider panel.

BRIEF DESCRIPTION OF THE DRAWINGS

The accompanying drawings, which are incorporated in and constitute a part of the specification, illustrate a preferred embodiment of the invention and, together with a general description of the invention given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the present invention there is provided a carton structure erectable by folding from a substantially flat blank comprising: two side panels, each having end edges; a bottom panel extending between the side panel; two top panels, each top panel extending inwardly from one of the side panels, the top panels spaced from the bottom panel; a center divider panel intermediate the two top panels and connected to each top panel; and two end panels, each extending from the bottom panel, each end panel having slot means for engaging the center divider panel when the carton is erected.

Figure 1:
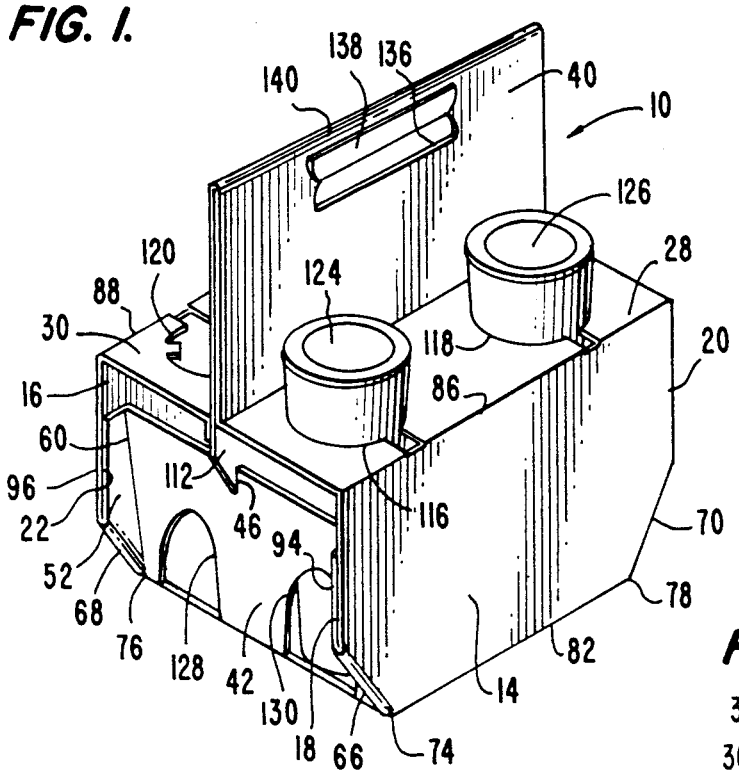
FIG. 1 is a perspective view of an erected carrier incorporating the teachings of the present invention.
Figure 3:
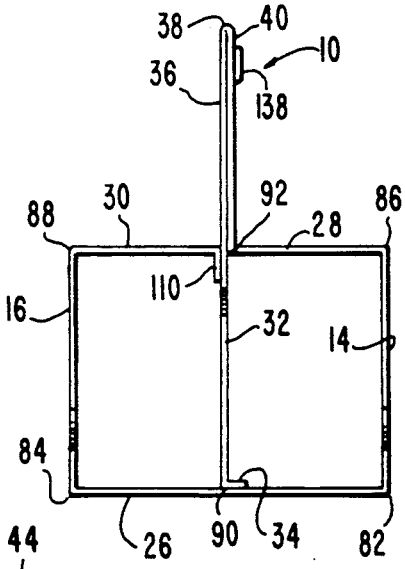
FIG. 3 is an end view of the carrier shown in FIG. 2.
Figure 2:
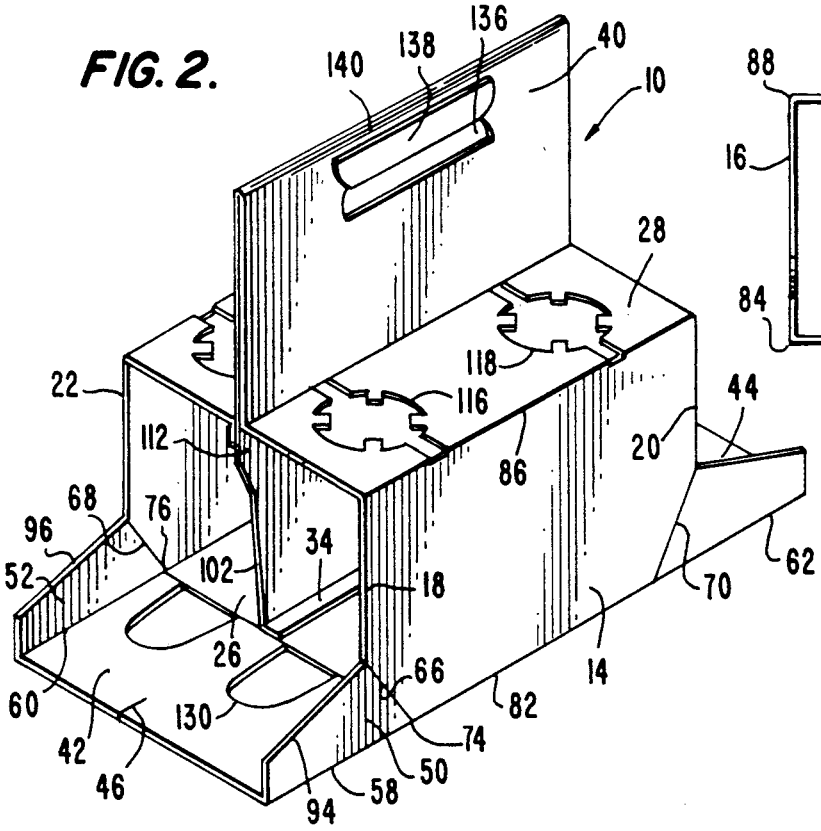
FIG. 2 is a perspective view of the carrier illustrated in FIG. 1 with the end panels in an unerected position.
Figure 4:
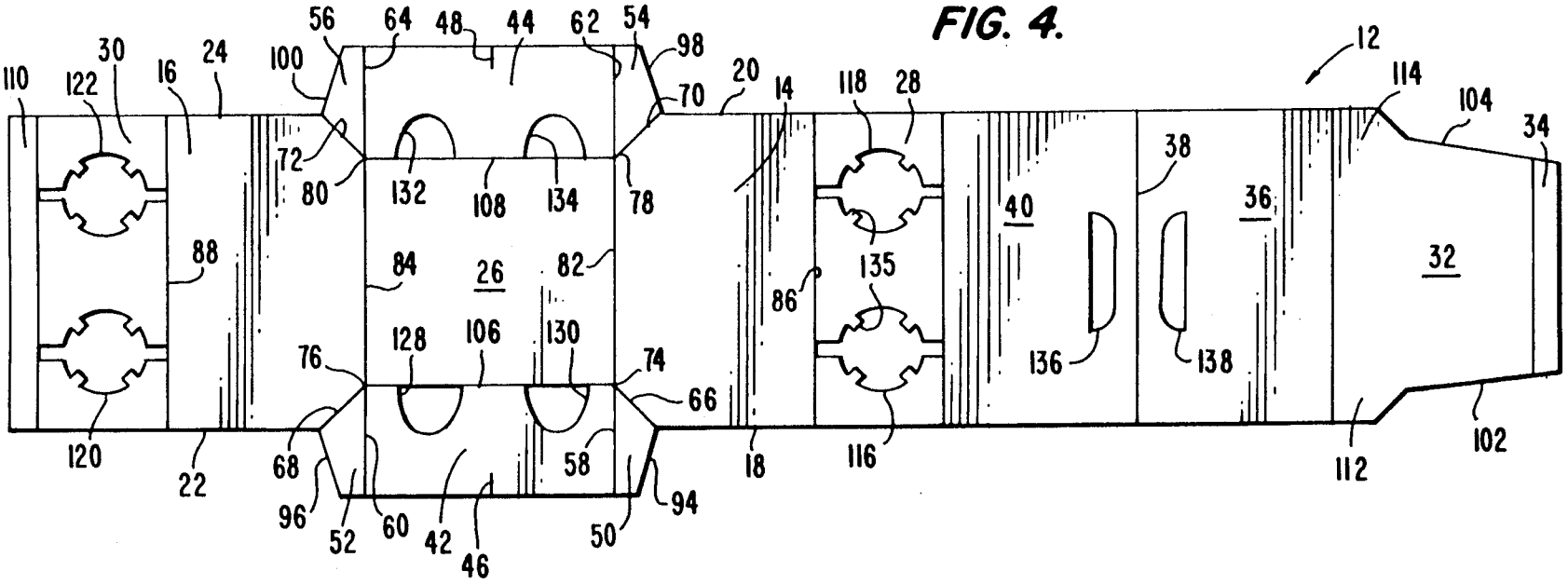
FIG. 4 is a top plan view of a substantially flat blank from which the erected carton structure shown in FIG. 1 is formed.

A substantially flat blank 12 is shown in FIG. 4. As shown in FIGS. 1–3, a carton structure 10 is erectable by folding blank 12. The carton structure 10 includes two side panels 14 and 16 each having end edges 18, 20, and 22, 24, respectively. A bottom panel 26 extends between side panels 14 and 16. As viewed in FIGS. 1 and 2, two top panels 28 and 30 extend inwardly from respective side panels 14 and 16.

A center divider panel is intermediate top panels 28 and 30. As best seen in FIGS. 3 and 4, it includes a lower portion 32 located between bottom panel 26 and top panels 28 and 30, and includes a flap 34 which is, adhered to the inside of bottom panel 26. Lower portion 32 extends upwardly past top panels 28 and 30 to form a first upper portion 36 of the center divider panel, is folded back upon itself to form the upper edge 38 of the center divider panel, and extends downward to form a second upper portion 40 of the center divider panel. The inside surface of first and second upper portions 36 and 40 preferably are bonded together to form a single unit.

As illustrated in FIG. 4, two end panels 42 and 44 each extend from bottom panel 26 and include slot means such as slots 46 and 48 for engaging part of the lower portion 32 of the center divider panel.

The carton structure includes four reinforcing areas 50, 52, 54 and 56. Each reinforcing area has a first edge connected by a first fold line 58, 60, 62, and 64, respectively to a side edge of one of the end panels 42 and 44, and a second edge connected by a second fold line 66, 68, 70 and 72, respectively to one of the side panels 14 and 16.

It can be seen that the first edge 58, 60, 62 and 64, respectively, and the second edge 66, 68, 70 and 72, respectively, intersect each other at an intersection 74, 76, 78 and 80, respectively, of the bottom panel 26 and one of the end panels 42 and 44 respectively.

Each reinforcing area 50, 52, 54 and 56 in an erected carton is in substantially laminar contact with the inside surface of an end portion of one of the side panels 14 and 16. As shown in FIG. 1, reinforcing area 52 is in substantially laminar contact with side panel 16.

Figure 5:
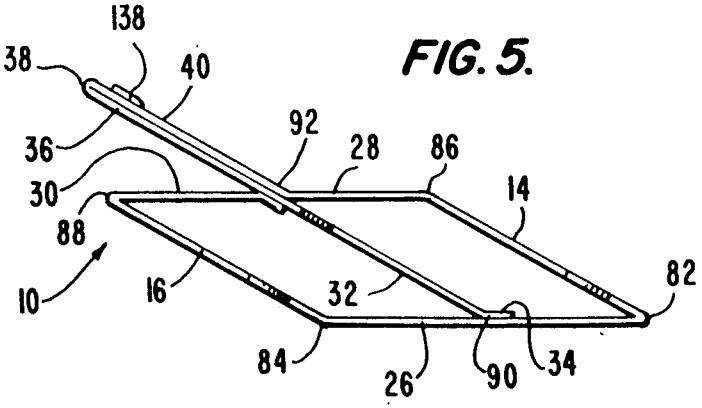
FIG. 5 is an end view of the carrier shown in FIG. 2 in a partially collapsed position.

As shown in FIGS. 4, each second edge 58, 60, 62 and 64, respectively, of each reinforcing area 50, 52, 54 and 56, respectively, is aligned with an intersection 82 and 84, respectively, between one of the side panels 14 and 16, respectively, and the bottom panel 26 when the carton is unerected. This allows the carton structure 10 to be collapsible into a flattened unit as shown in FIG. 5 after the blank 12 has been folded and bonded as shown in FIGS. 2 and 3, but not fully erected into the position shown in FIG. 1. Such alignment of fold lines allows the carton structure shown in FIG. 3 to be folded along lines 82, 84, 86, 88, 90 and 92 to form a flattened structure which folds along the fold lines. This flattened structure is convenient for compact storage of the unit which can be easily erected from this flattened position into the partially erected position shown in FIG. 2 and then to the fully erected position shown in FIG. 1.

The relationship between side panels 14 and 16, end panels 42 and 44 and bottom panel 26 is such that the length of bottom panel 26 between the two end panels 42 and 44 is less than the length of the side panels 14 and 16 and also less than the length of top panels 28 and 30. As shown in FIG. 1, this disparity in length causes top panels 28 and 30 to overhang the ends of bottom panel 26. As also shown in FIG. 1, reinforcing areas 50, 52, 54 and 56 each include a free edge 94, 96, 98 and 100, respectively, which are in alignment with the respective end edges 18, 22, 20 and 24 of the side panels 14 and 16 when the carton is erected.

As best seen in FIGS. 2 and 4, the center divider panel includes two free end portions 102 and 104, each free end portion 102 and 104 is positioned along the inside surface of one of the end panels 42 and 44, respectively, between the slot means 46 and 48, respectively, and the lower edge 106 and 108, respectively, of end panels 42 and 44 when the carton is erected from the position shown in FIG. 2 to the position shown in FIG. 1. It is seen that in the preferred embodiment shown in the drawing, the slot means 46 and 48 is positioned in the upper edge of each end panel.

As best seen in FIGS. 3 and 4, blank 12 is a single sheet folded and extending so that one end of the sheet at flap 34 is attached to the inside of the bottom panel 26, as shown in FIG. 3, then extending upward to form a lower portion 32 of the center divider panel, extending further upward past the two top panels 30 and 28 to form a first upper portion 36 of the center divider panel, folded back upon itself to form the upper edge 38 of the center divider panel, extending downward to form a second upper portion 40 of the center divider panel, extending outward to form one of the top panels 28 extending downward to form one of the side panels 14 extending horizontally to form the bottom panel 26, extending upward to form the second side panel 16, extending inward to form the second top panel 30 extending from the second top panel 30 and attached to the center divider panel by a reinforcing flap 110.

It can be seen that each side panel 14 and 16 includes a top edge 86 and 88, respectively, a bottom edge 82 and 84, respectively, substantially parallel to and shorter than the top edge 86 and 88 respectively, two parallel end edge portions 18, 20, and 22, 24, respectively, and two fold line end edge portions 66, 70, and 68, 72, respectively, each extending at an angle downward and inward from one of the end edge portions 18, 20, and 22, 24, respectively, to the bottom edge 82 and 84, respectively.

Lower portion 32 of the center divider panel, is located below the top panels 28 and 30 and has an edge 102 and 104, respectively, at each end which extends upward from the bottom panel 26 and then extends outward to form tab means such as tabs 112 and 114 which engage slots 46 and 48, respectively.

It is noted that the one piece blank 12 and the folded construction described above allow bottom panel 26 to have fold lines 82, 84, 106 and 108 only at its edges. Bottom 26 has no internal fold lines which reduce the rigidity or otherwise weaken the carrier structure.

Top panels 28 and 30 include opening means such as openings 116, 118, 120 and 122 respectively, for receiving and holding containers 124 and 126. Openings 116, 118, 120 and 122 include inwardly directed tabs 135 which accommodate and secure containers 124 and 126 of different sizes.

Each end panel 42 and 44, respectively, have two cut out portions 128, 130 and 132, 134, respectively, to accommodate the lower portions of containers such as 124 and 126 which would otherwise not be accommodated by the lower portion of end panels 42 and 44 due to their undercut nature described above. In addition, such cut out portions allow the end panels 42 and 44 to be easily erected.

The center divider panel includes aperture means such as cut out portions 136 and 138 to form a handle 140 for carrying the carton structure. As shown in FIGS. 1 and 2, cut out portion 136 is completely cut out whereas cut out portion 138 is cut out only along its bottom and side walls and folded up around the top edge of cut out portion 136 for comfort in carrying the carton structure.

As noted, the carton structure is assembled into a configuration most clearly seen in FIG. 3 by folding along lines 82, 84, 86, 88, 38 and 92, glueing reinforcing flap 110 to lower portion 32 of the center divider panel, and glueing flap 34 to bottom panel 26. The carton structure may be then collapsed into a flattened state for compact storage as shown in FIG. 5. It should be evident that the arrangement shown in FIG. 5 can be flattened further and as shown in this slightly expanded position for sake of clarity.

When the carton is to be used, it is erected by first expanding the structure from the arrangement shown in FIG. 5 to the arrangement shown in FIGS. 2 and 3. Then the carton is fully erected by reverse folding the fold lines 58, 60, 62, and 64 while folding end panels 42 and 44 to the upright position shown in FIG. 1 so that slots 46 and 48 engage tabs 112 and 114. The panels of the carton are thereby rigidly locked in place and the carton is now ready for loading by placement of containers 124 and 126 in openings 116 and 118.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of applicant's general inventive concept.

What is claimed is:

1. A carton structure erectable by folding from a substantially flat blank comprising:

two side panels, each having end edges;

a bottom panel extending between the side panels;

two top panels, each top panel extending inwardly from one of the side panels, the top panels spaced from the bottom panel;

a center divider panel intermediate the two top panels and connected to each top panel;

two end panels, each extending from the bottom panel, each end panel having slot means for engaging the center divider panel when the carton is erected; and means for locking the slot means into engagement with the center divider panel including reinforcing areas, each reinforcing area having a first edge connected by a first fold line to a side edge of one of the end panels and a second edge connected by a second fold line to one of the side panels.

2. A carton structure as claimed in claim 1 wherein the center divider panel is connected to both the top panels and the bottom panel.

3. A carton structure as claimed in claim 1 wherein the first edge and the second edge of each reinforcing area intersect each other at an intersection of the bottom panel and one of the end panels.

4. A carton structure as claimed in claim 1 wherein each reinforcing area in an erected carton is in substantially laminar contact with the inside surface of an end portion of one of the side panels.

5. A carton structure as claimed in claim 1 wherein the second edge of each reinforcing area is aligned with an intersection between one of the side panels and the bottom panel when the carton is unerected, whereby the carton structure is collapsable into a flattened unit.

6. A carton structure as claimed in claim 1 wherein the length of the bottom panel between the two end panels is less than the length of the side panels.

7. A carton structure as claimed in claim 5 wherein the first and second edges of each reinforcing area intersect at a corner formed by one of the end panels, one of the side panels, and the bottom panel.

8. A carton structure as claimed in claim 1 wherein each reinforcing area includes a free edge in alignment with the end edge of one of the side panels when the carton is erected.

9. A carton structure as claimed in claim 1 wherein the center divider panel includes two free end portions, each free end portion positioned along the inside surface of one of the end panels between the slot means and the lower edge of the end panel when the carton is erected.

10. A carton structure as claimed in claim 1 wherein the slot means is positioned in the upper edge of each end panel.

11. A carton structure as claimed in claim 1 wherein the blank is a single sheet folded and extending so that one end of the sheet is attached to the inside of the bottom panel, extending upward to form a lower portion of the center divider panel, extending further upward past the two top panels to form a first upper portion of the center divider panel, folded back upon itself to form the upper edge of the center divider panel, extending downward to form a second upper portion of the center divider panel, extending outward to form one of the top panels, extending downward to form one of the side panels, extending horizontally to form the bottom panel, extending upward to form the second side panel, extending inward to form the second top panel, extending from the second top panel and attached to the center divider panel.

12. A carton structure as claimed in claim 1 wherein the bottom panel has fold lines only at its edges.

13. A carton structure as claimed in claim 1 wherein the top panels include opening means for receiving and holding containers.

14. A carton structure as claimed in claim 1 wherein the center divider panel includes aperture means for defining a handle for carrying the carton structure.

15. A carton structure as claimed in claim 1 including a reinforcing flap extending from one of the top panels, the flap bonded to the center divider panel.

16. A carton structure as claimed in claim 1 wherein each of the end panels include a cut out portion on each side of the center divider panel.

17. A carton structure as claimed in claim 16 wherein the cut out portions extend to the bottom edge of each end panel.

18. A carton structure as claimed in claim 1 wherein each side panel includes a top edge, a bottom edge substantially parallel to and shorter than the top edge, two parallel end edge portions extending downward from the top edge, and two fold line end edge portions, each extending at an angle downward and inward from one of the end edge portions to the bottom edge.

19. A carton structure as claimed in claim 1 wherein the center divider panel includes a lower portion below the top panels, having an edge at each end, each edge extending upward from the bottom panel and then extending outward to form tab means for engaging the slot means.

* * * * *